US011555677B2

(12) United States Patent
Frizzell

(10) Patent No.: US 11,555,677 B2
(45) Date of Patent: Jan. 17, 2023

(54) AERODYNAMICALLY IMPROVED AND DYNAMICALLY STABILIZED BULLET

(71) Applicant: David Dean Frizzell, Holt, MO (US)

(72) Inventor: David Dean Frizzell, Holt, MO (US)

( * ) Notice: Subject to any disclaimer, the term of this patent is extended or adjusted under 35 U.S.C. 154(b) by 36 days.

(21) Appl. No.: 17/239,031

(22) Filed: Apr. 23, 2021

(65) Prior Publication Data

US 2022/0128340 A1 Apr. 28, 2022

Related U.S. Application Data

(60) Provisional application No. 63/005,385, filed on Apr. 5, 2020.

(51) Int. Cl.
*F42B 10/02* (2006.01)
*F42B 10/42* (2006.01)

(52) U.S. Cl.
CPC ..... *F42B 10/025* (2013.01); *F42B 10/42* (2013.01)

(58) Field of Classification Search
CPC ..... F42B 10/025; F42B 10/42
USPC ..... 102/490
See application file for complete search history.

(56) References Cited

U.S. PATENT DOCUMENTS 4,243,036 A * 1/1981 Ott ..... F42B 12/54 473/581
4,822,340 A * 4/1989 Kamstra ..... A61M 5/3129 604/199
4,863,428 A * 9/1989 Chevalier ..... F42B 12/54 102/512
5,176,643 A * 1/1993 Kramer ..... A61M 5/2033 604/272
5,957,897 A * 9/1999 Jeffrey ..... A61M 5/3234 604/110
6,862,994 B2 * 3/2005 Chang ..... H05C 1/06 119/908
7,065,915 B2 * 6/2006 Chang ..... F41C 9/00 42/84
7,083,140 B1 * 8/2006 Dooley ..... F42B 10/14 244/45 R
7,434,517 B1 * 10/2008 Linker ..... F41H 13/0025 361/232
8,074,573 B1 * 12/2011 Linker ..... F41H 13/0025 102/502
8,261,665 B1 * 9/2012 Walsh ..... F42B 10/06 102/513
11,307,008 B2 * 4/2022 Buys ..... A61M 5/329
2003/0167956 A1 * 9/2003 Kellner ..... F42B 12/208 102/517
2005/0044768 A1 * 3/2005 Edwards ..... F41A 17/06 42/1.08
2022/0128340 A1 * 4/2022 Frizzell ..... F42B 10/42

* cited by examiner

*Primary Examiner* — Samir Abdosh
(74) *Attorney, Agent, or Firm* — Dale J. Ream

(57) ABSTRACT

An aerodynamically improved bullet mounted atop a bullet and fired from a discharge chamber of a gun includes a bullet having a rear portion and a front portion that, together, defines an interior area. A rod having a linear and elongate configuration is movable between a retracted configuration completely inside the interior area and an extended configuration partially extending forwardly of the bullet the rod being pushed downstream by the gas pressures of the discharged bullet itself.

17 Claims, 5 Drawing Sheets

AERODYNAMICALLY IMPROVED AND DYNAMICALLY STABILIZED BULLET

REFERENCE TO RELATED APPLICATIONS

This application claims the benefit of Provisional patent application 63/005,385, filed Apr. 5, 2020, and titled Aerodynamically Improved and Dynamically Stabilized Bullet, which is incorporated in its entirety herein.

BACKGROUND OF THE INVENTION

This invention relates generally to projectiles and, more particularly, to a bullet having an aerodynamically improved and dynamically stabilized structure. Specifically, the aerodynamically improved bullet has a rod that is situated completely inside an interior area of the bullet when in a retracted configuration and extended partially outside the front end of the bullet in a deployed configuration so as to enhance the flight telemetry of the bullet when discharged from a gun.

In long range shooting, the desire is to have a bullet with stable characteristics and very low aerodynamic drag. Maximizing both speed and accuracy in long range shooting is dependent on having a bullet that maximizes aerodynamics while eliminating any structures that foster resistance or air drag. It is known in military and flight applications that have a small diameter rod extending forwardly from a tip of a projectile promotes aerodynamics by reducing air resistance. Specifically, the extended rod breaks up or cuts through the air in front of a larger mass so as to reduce resistance and decrease speed loss.

The pressure in the firing chamber of a rifle for long range shooting is typically 40,000 to 75,000 psi. Therefore, it would be desirable to use this pressure to extend a rod from the tip of a bullet and, as a result, reduce air resistance and increase the speed and accuracy of a bullet down range.

SUMMARY OF THE INVENTION

An aerodynamically improved bullet mounted atop a bullet and fired from a discharge chamber of a gun according to the present invention includes a bullet having a rear portion and a front portion that, together, define an interior area. A piston rod having a linear and elongate configuration is positioned within a chute and is movable between a retracted configuration completely inside the interior area and an extended (deployed) configuration partially extending forwardly of the bullet, the rod being pushed downstream by the gas pressures of the discharged bullet itself.

Therefore, a general object of this invention is to provide an aerodynamically superior bullet that uses the natural gas pressures of a discharged bullet to extend a rod from the front of a bullet so as to decrease air drag and increase aerodynamic advantages.

Another object of this invention is to provide an aerodynamically superior bullet, as aforesaid, that provides a rod at a retracted configuration situated completely within a bullets interior to an extended configuration at least partially extending forwardly from the front of the bullet.

Still another object of this invention is to provide an aerodynamically improved and dynamically stabilized bullet, as aforesaid, that includes an internal sleeve and gyroscopic stabilization structures that enhance the aerodynamic efficiency of the bullet during flight.

Other objects and advantages of the present invention will become apparent from the following description taken in connection with the accompanying drawings, wherein is set forth by way of illustration and example, embodiment of this invention.

DESCRIPTION OF THE PREFERRED EMBODIMENT

Figure 1A:
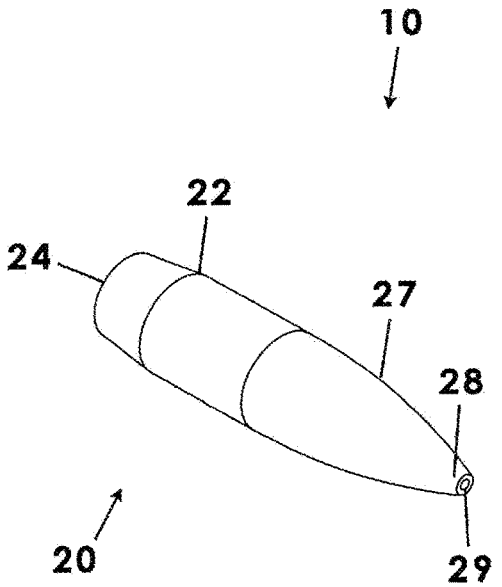
FIG. 1*a* is a perspective view of an aerodynamically stabilized bullet mounted atop a bullet cartridge according the present invention, illustrated with a rod in a retracted configuration.

An aerodynamically stabilized bullet according to a preferred embodiment of the present invention will now be described with reference to FIGS. 1*a* to 5*b* of the accompanying drawings. The aerodynamically stabilized bullet 10 includes a bullet 20 having a rear portion 22 and a front portion 27 that, together, define an interior area 21 in which is positioned a rod 30 that is movable between a retracted configuration completely inside the interior area 21 and a deployed configuration partially extending forwardly and outside of the interior area 21.

First, it will be understood that the bullet is a projectile that is coupled to a top end of a cartridge 8 or case, such as in a tight friction fit. The bullet 10 may be referred to as the 10 projectile mounted atop the cartridge 8 and is the part actually propelled through and from the barrel of a firearm upon discharge or explosion of the propellant inside the case. The bullet 20 may have a unitary construction in manufacturing but is best understood by considering its two portions. Namely, the bullet 20 may include a rear portion 22 and a front portion 27 connected to and extending forwardly of the rear portion 22. The rear portion 22 has a rear end 24 that is, at first, coupled to a top of the case. The rear portion 22 may have a generally cylindrical configuration although in the case of rifle bullets, may have a swollen or convex shape configuration. The rear portion 22 is symmetrical in its shape and defines a central and longitudinal axis.

The bullet 20 includes a front portion 27 coupled to and extending forwardly of the rear portion 22. The front portion 27 may be seen as having a forwardly converging configuration or as being forwardly arched down to a terminal end which may also be referred to as the apex 28. In the preferred embodiment, the apex 28 defines an opening 29, i.e., has an open end through which a rod 30 will extend as will be explained in more detail later. Further, the rear portion 22 and front portion 27, when considered as being coupled or molded together, define an interior area 21.

Figure 1B:
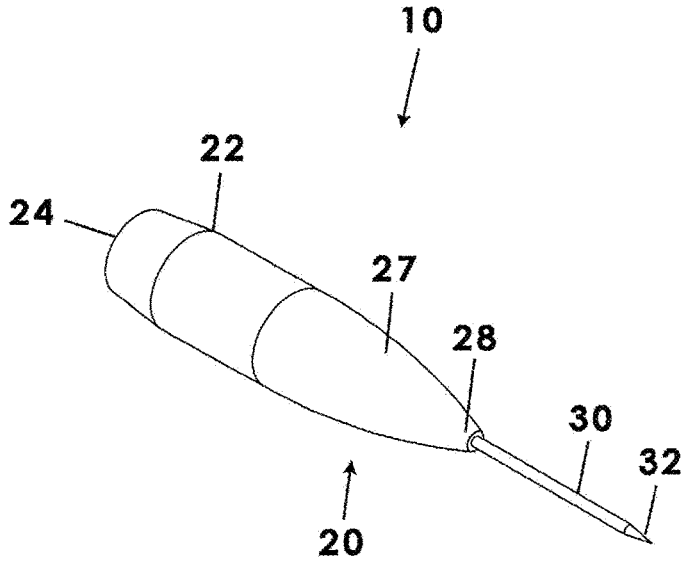
FIG. 1*b* is perspective view of the bullet as in FIG. 1*a* illustrated with a rod in a deployed configuration.
Figure 1C:
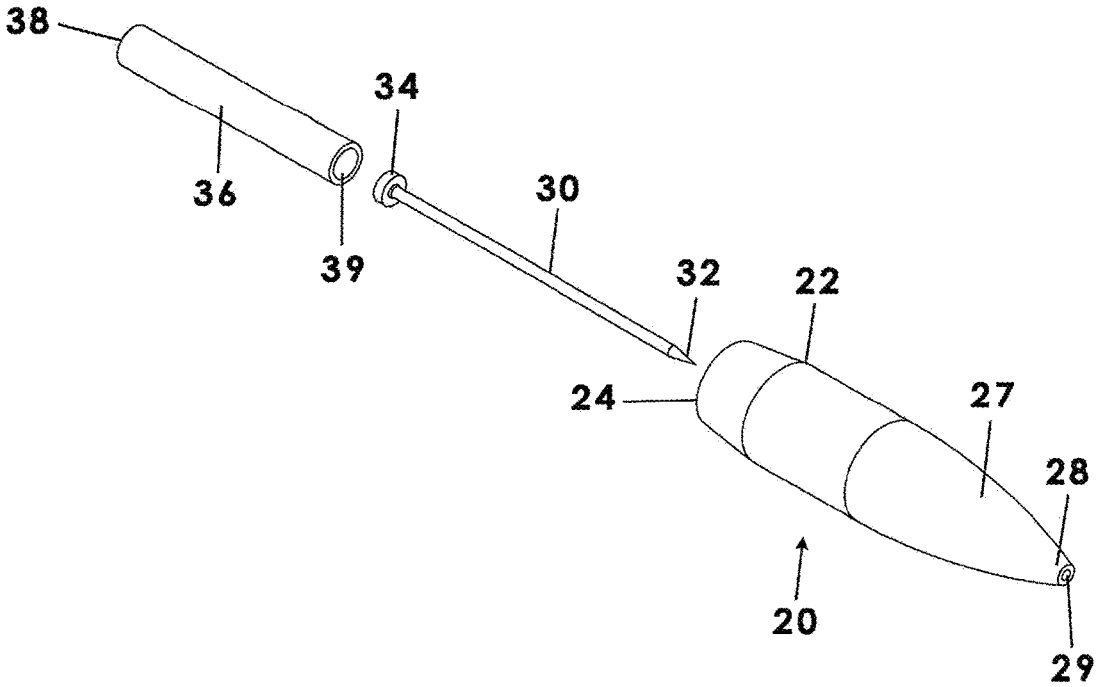
FIG. 1*c* is an exploded view of the bullet as in FIG. 1*a;*
Figure 2A:
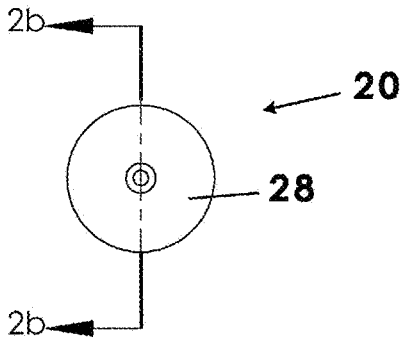
FIG. 2*a* is end view of the bullet as in FIG. 1*a;*
Figure 2B:
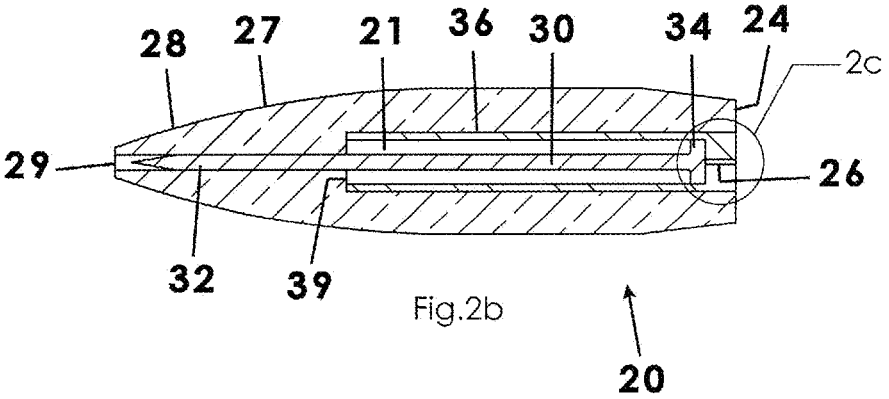
FIG. 2*b* is a sectional view taken along line 2*b*-2*b* of FIG. 2*a;*
Figure 2C:
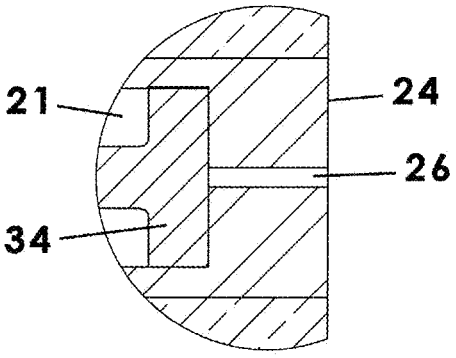
FIG. 2*c* is an isolated view on an enlarged scale taken from FIG. 2*b;*
Figure 3A:
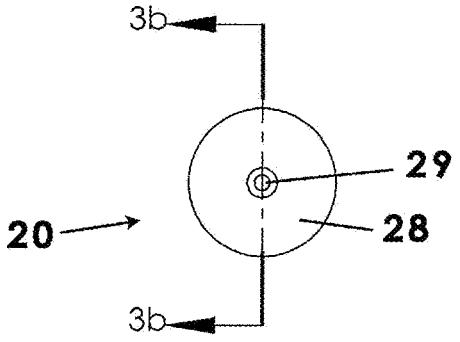
FIG. 3*a* is an end view of the bullet as in FIG. 1*b;*
Figure 3B:
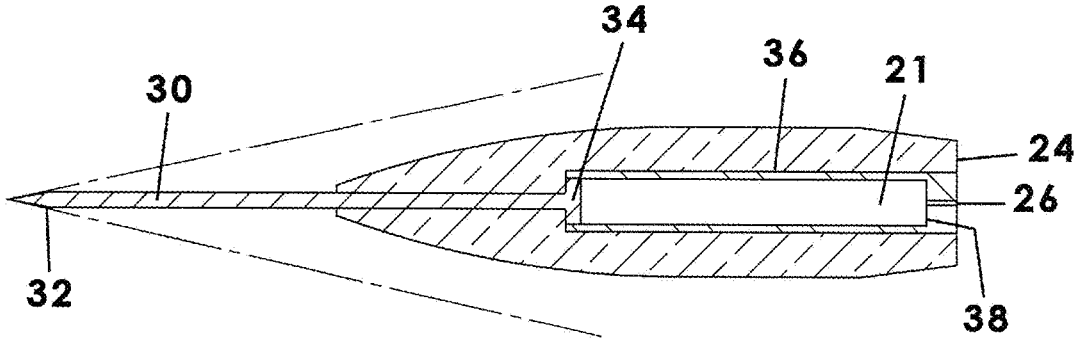
FIG. 3*b* is a sectional view taken along line 3*b*-3*b* of FIG. 3*a;*

Next, the aerodynamically stabilized bullet 10 includes a rod 30 having a cylindrical configuration having a small diameter and a linear configuration. Preferably, the rod 30 is positioned within the interior area 21 of the bullet and is movable between a retracted configuration in which the rod 30 is situated entirely inside the interior area 21 (FIGS. 1*a* and 2*b*) and a deployed configuration downstream from the refracted configuration and at which an upstream portion of the rod 30 is still positioned in the interior area 21 and a downstream portion is forwardly outside of the interior area 21 (FIGS. 1*b* and 3*b*). Specifically, the upstream portion of the rod 30 is slidably extended through the apex opening 29 and extended away therefrom at the deployed configuration (FIG. 3*b*). The rod 30 may have a rod tip 32 having an even smaller diameter than the rod per se and a geometry that is advantageous for aerodynamic stability. Opposite the rod tip 32, the rod 30 may include a piston 34 at an upstream rod end (FIG. 2*c*). The piston 34 has a dimension that enables it to move slidably in the interior of the chute but is also configured to push the rod downstream in the chute 36 by the discharge gases as will be described more fully later.

In order to accomplish an object of the present invention to stabilize the trajectory of the bullet 10, the aerodynamically stabilized bullet 10 may include what will be referred to as a chute 36 positioned inside the interior area 21 of the bullet 20 and along the longitudinal axis defined thereby. The chute may also be referred to as a sleeve. More particularly, the chute 36 may have a linear and cylindrical configuration, having opposed open ends and defining a hollow interior space therebetween. In other words, the chute 36 is a hollow sleeve. The chute 36 may include an inlet end 38 adjacent the rear end 24 of the bullet 20 and an outlet end 39 downstream but still inside the interior space. The chute 36 may have a diameter that is slightly larger than a diameter of the rod 30 so that the rod 30 may be selectively received within the chute 36 at the retracted configuration (FIG. 2*b*). Then, the rod 30 extends downstream forwardly of the chute 36 when pushed downstream by the discharge gases that result from the combustion of propellant when a round of ammunition is discharged as will be discussed below.

As the bullet is fired, gas pressures within the firing chamber force the piston 34 forward within the interior area 21 of the bullet 20. The piston 34 forces the rod 30 downstream toward the deployed configuration described above as the bullet is propelled down the barrel of a gun.

In a related aspect, the rear end 24 of the rear portion 22 of the bullet 20 may define an orifice 26 that is in fluid communication with the interior area 21 (FIG. 2*c*). In other words, discharge gases generated inside the chamber of the firearm upon firing a shot may be pushed forcibly through the orifice 26 and into the interior area 21 where the piston 34 of the rod 30 is encountered and pushed downstream. It is understood that the diameter of the orifice is a predetermined diameter and that a volume of discharge gases allowed to flow into 20 the interior area 21 is directly related to that diameter. A sufficient amount of energy is needed to extend the rod 30 but not so much that rod 30 is pushed completely out of the bullet 20. In fact, the orifice 26 may be manufactured and sold in different sizes to have differing effects on pushing the rod 30 downstream within the bullet 20.

Many of the modern bullet offerings are too long to fully stabilize in conventional twist rates. Longer bullets in particular need to spin faster than shorter bullets in order to achieve gyroscopic stability ("SG"). In order to maximize the benefits of these high-performance bullets, shooters need to have a basic understanding of stability to select a suitable twist rate. Stability is quantified by the gyroscopic stability factor, SG. A bullet that is fired with inadequate spin will have an SG less than 1.0 and will tumble right out of the barrel. If the bullet spins fast enough to achieve an SG of 1.5 or higher, it will fly point forward with accuracy and minimal drag. This issue is addressed in the present invention by the structure described below.

Figure 4A:
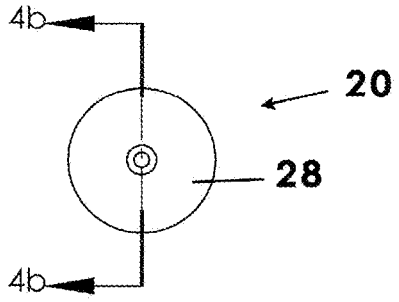
FIG. 4*a* is an end view of the bullet as in FIG. 1.
Figure 4B:
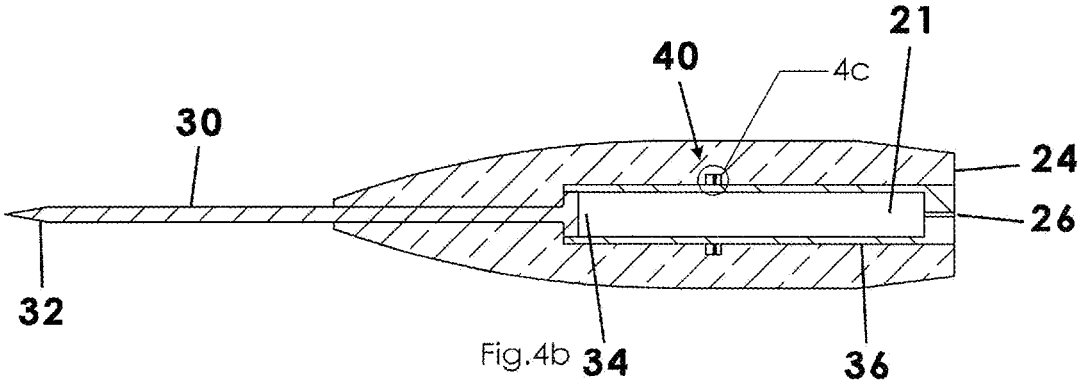
FIG. 4*b* is a sectional view taken along line 4*b*-4*b* of FIG. 4*a;*
Figure 4C:
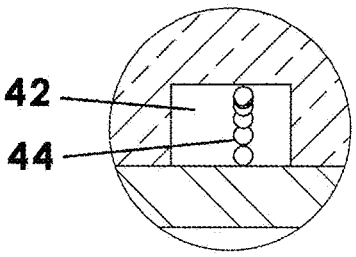
FIG. 4*c* is an isolated view on an enlarged scale taken from FIG. 4*b;*
Figure 5A:
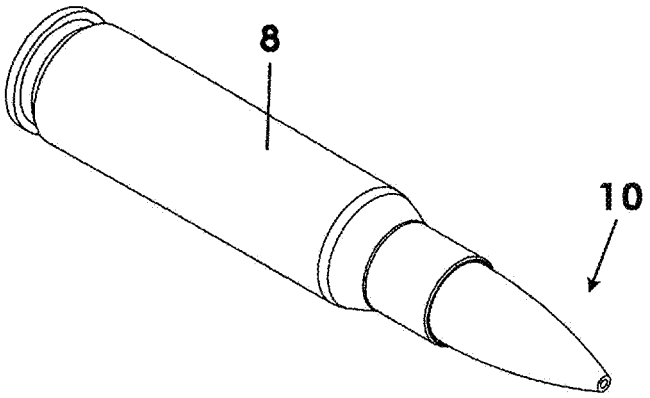
FIG. 5*a* is a perspective view of a rifle bullet cartridge and bullet combination according to the present invention.
Figure 5B:
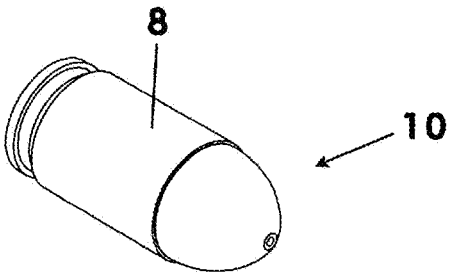
FIG. 5*b* is a perspective view of a handgun bullet cartridge and bullet combination according to the present invention

In an embodiment shown in FIGS. 4*a* to 4*c*, the aerodynamically stabilized bullet 10 may include a gyroscopic stabilizer assembly 40 configured to give additional stability and accuracy to the trajectory of the bullet. More particularly, an inner surface of the bullet 20 may define a ring 42 defining a hollow interior space. A plurality of balancing material 44, such as a plurality of small balls or needles constructed of metal or ceramic, may be situated inside the ring 42 and are free to move freely as the bullet 20 rotates while in a gun barrel and during flight. It will be understood that the balancing material will encircle the chute 36 in a centrifugal manner so as to enhance the aerodynamic efficiency and accuracy of the bullet 20. In an embodiment, the balancing material include a fluid either by itself or in conjunction with the balls or needles to dynamically stabilize the bullet. A fluid might be beneficial as there is tremendous g-forces exerted on the projectile as it accelerates down the barrel.

Therefore, the present invention proposes at least three structures that, in combination, improve the aerodynamic efficiency of the bullet's travels though the barrel of a gun and in flight, namely, the deployment of the rod 30 using combustion gases, the internal chute 36, and the gyroscopic stabilizer assembly 40.

In use, firing the aerodynamically stabilized bullet according to the present invention improves both the speed and accuracy of the bullet over bullets not having the inventive structure described above. Specifically, the extended rod decreases the aerodynamic drag on the bullet's flight as has been shown by monitoring the flight velocities downstream using a Doppler radar system. Actual test data suggests that a standard ballistics coefficient is 20 increased by 9%.

It is understood that while certain forms of this invention have been illustrated and described, it is not limited thereto except insofar as such limitations are included in the following claims and allowable functional equivalents thereof.

The invention claimed is:

1. An aerodynamically stabilized bullet that is propelled away from a bullet case upon an explosive discharge of a propellant inside the bullet case caused by a firing of a firearm, said bullet comprising:

a body member having a rear portion and a front portion coupled to and extending forwardly from the rear portion therefrom, the rear portion having a generally cylindrical configuration defining a longitudinal axis and the front portion having a forwardly converging outer wall that forms an apex defining an aperture;

wherein said rear portion and said front portion of said body member, together, define an interior area;

wherein said rear portion has a rear end that is coupled to an upper end of the bullet case prior to the discharge;

a chute positioned in said interior area of said body along said longitudinal axis, said chute having an inlet end adjacent and in communication with the rear end of the rear portion of the body member and an outlet end downstream from said inlet end; and a piston rod having a cylindrical, linear, and elongate configuration includes a piston at an upstream end and a rod tip at a downstream end opposite said piston, said rod being slidably movable in a downstream direction from a retracted configuration at which said piston is adjacent said inlet end of said chute and a deployed configuration at which said piston is adjacent said outlet end;

wherein said rod tip is substantially inside said interior area of said body member at said refracted configuration and said rod tip is substantially outside said interior area at said deployed configuration.

2. The bullet as in claim 1, wherein said inlet end of said chute includes a diameter larger than a diameter of said piston so that said piston rod is received and movable downstream in said chute and said outlet end includes a diameter small than a diameter of said piston so as to stop downstream movement of said piston rod.

3. The bullet as in claim 1, wherein said piston rod is pushed downstream in said chute by gas pressure generated by the discharge of the propellent impacting said piston of said piston rod.

4. The bullet as in claim 1, wherein said rear end of said rear portion defines an orifice that allows the gas pressures generated by the discharge of propellant to flow into said interior area so as to impact said piston.

5. The bullet as in claim 1, further comprising a gyroscopic stabilizer assembly situated in said interior area of said body member.

6. The bullet as in claim 5, wherein said gyroscopic stabilizer assembly includes:

a ring defined by an inner surface of the body member and that defines a hollow area;

a balancing material situated loosely in said ring and that moves freely upon a centrifugal motion of said body member.

7. The bullet as in claim 6, wherein said balancing material includes a plurality of balls each having a small diameter.

8. The bullet as in claim 6, wherein said balancing material includes a plurality of needles each having a small diameter.

9. An aerodynamically stabilized bullet that is propelled away from a bullet case upon an explosive discharge of a propellant inside the bullet case, said bullet comprising:

a body member having a rear portion and a front portion coupled to and extending forwardly from the rear portion therefrom, the rear portion defining a longitudinal axis and the front portion having a forwardly converging outer wall defining an aperture;

wherein said rear portion and said front portion of said body member, together, define an interior area;

a chute positioned in said interior area of said body along said longitudinal axis, said chute having an inlet end adjacent and in communication with the rear portion of the body member and an outlet end downstream from said inlet end; and a piston rod having a cylindrical, linear, and elongate configuration has a piston at an upstream end and a rod tip at a downstream end opposite said piston, said rod being slidably movable in a downstream direction from a retracted configuration at which said piston is adjacent said inlet end of said chute and a deployed configuration at which said piston is adjacent said outlet end;

wherein said piston rod is pushed downstream in said chute by gas pressure generated by the discharge of the propellent impacting said piston of said piston rod;

wherein said rod tip is substantially inside said interior area of said body member at said retracted configuration and said rod tip is substantially outside said interior area at said deployed configuration.

10. The bullet as in claim 9, wherein said inlet end of said chute includes a diameter larger than a diameter of said piston so that said piston rod is received and movable downstream in said chute and said outlet end includes a diameter small than a diameter of said piston so as to stop downstream movement of said piston rod.

11. The bullet as in claim 9, wherein said rear portion of the body includes a rear end defining an orifice in fluid communication with said interior area of said body member.

12. The bullet as in claim 9, wherein said piston rod is pushed downstream in said chute by gas pressure generated by the discharge of the propellent impacting said piston of said piston rod.

13. The bullet as in claim 11, wherein said rear end of said rear portion defines an orifice that allows the gas pressures generated by the discharge of propellant to flow into said interior area so as to impact said piston.

14. The bullet as in claim 12, further comprising a gyroscopic stabilizer assembly situated in said interior area of said body member.

15. The bullet as in claim 12, wherein said gyroscopic stabilizer assembly includes:

a ring defined by an inner surface of the body member and that defines a hollow area; and a balancing material situated loosely in said ring and that moves freely upon a centrifugal motion of said body member.

16. The bullet as in claim 15, wherein said balancing material includes a plurality of balls each having a small diameter.

17. The bullet as in claim 15, wherein said balancing material includes a plurality of needles each having a small diameter.

* * * * *